US005463987A

United States Patent [19]

Cukovich

[11] Patent Number: 5,463,987

[45] Date of Patent: Nov. 7, 1995

[54] VARIABLE VALVE TIMING MECHANISM

[76] Inventor: Mark S. Cukovich, 335 Beacon Rd., Renfrow, Pa. 16053

[21] Appl. No.: 274,309

[22] Filed: Jul. 13, 1994

[51] Int. Cl.[6] ..... F01L 13/00

[52] U.S. Cl. ..... 123/90.15; 251/285; 137/624.15

[58] Field of Search ..... 123/90.15, 90.16, 123/90.27; 251/213, 285; 137/624.15

[56] References Cited

U.S. PATENT DOCUMENTS

| | | | |
|---|---|---|---|
| 2,260,983 | 10/1941 | Walker | 123/90.16 |
| 3,911,879 | 10/1975 | Altmann | 123/90.16 |
| 4,138,973 | 2/1979 | Luria | 123/90.16 |
| 4,414,931 | 11/1983 | Burandt | 123/90.16 |
| 4,484,546 | 11/1984 | Burandt | 123/90.15 |
| 5,119,773 | 6/1992 | Schön et al. | 123/90.16 |
| 5,165,370 | 11/1992 | Beaumont | 123/90.16 |

FOREIGN PATENT DOCUMENTS

| | | | |
|---|---|---|---|
| 2484016 | 12/1981 | France | 123/90.16 |
| 2335634 | 1/1975 | Germany | 123/90.16 |

*Primary Examiner*—Henry C. Yuen
*Assistant Examiner*—Weilun Lo
*Attorney, Agent, or Firm*—Titus & McConomy

[57] ABSTRACT

A variable valve timing mechanism for controlling at least one biased valve comprising a guide assembly having a mounting surface and a spaced apart upper guide surface. The guide assembly includes spaced apart longitudinal guides; a closing stop positioned on the mounting surface and a stop surface. An opening stop is positioned on the guide assembly and has a stop surface. A valve activator is movably positioned within the guide assembly and in operable contact with the biased valve. The valve activator has first and second stop surfaces to contact a respective closing stop and opening stop, and includes an angled contact surface. A drive ram is movably positioned within said guide assembly and in contact with the upper guide surface and the valve activator. The drive ram has an angled drive surface positioned for contacting the valve activator and is connected to a drive for imparting reciprocating motion thereto. The drive is synchronized with the operation of the valve.

23 Claims, 16 Drawing Sheets

VARIABLE VALVE TIMING MECHANISM

FIELD OF THE INVENTION

The present invention relates to a variable valve timing mechanism for internal combustion engines, and in particular to a valve timing device that is selectively variable over 360° of engine crank.

BACKGROUND OF THE INVENTION

Variable valve engine timing has been used to accomplish the competing objectives of good fuel economy and wide open throttle acceleration over a significant portion of the engine speed range. To achieve variability of valve timing, numerous mechanisms have been proposed which typically provide a two-mode change-over between low and high speed engine operation. Recently, however, a mechanism has been described, Multi-Mode Variable Valve Timing Engine, Automotive Engineering/February 1994, p. 111–114 which provides multi-mode valve timing variability. This device has been stated to provide better engine output and fuel economy using a unique hydraulic mechanism for three-mode change-overs.

The device provides for the deactivation of both intake and exhaust valves, select low-speed cam with moderate lift and short duration and select high-speed cam with high lift and long duration. This device enables shutting off unnecessary cylinders during low-speed cruising or selecting optimum valve events during wide open throttle acceleration over the entire engine speed range. The modes are automatically selected by the engine control depending upon the engine's operating condition. The device consists of two different cams with low speed and high speed profiles, two rocker arms with roller followers, a valve actuating T-shaped lever with shaft, and two hydraulic pistons incorporated into the shaft. The hydraulic pistons are used to push and pull the shaft into low and high speed operation. While this mechanism achieves increased power output and fuel economy, it is very complicated in structure and operation. Other prior art devices exist which purport to provide variability in timing; however, they are also complicated and expensive to operate. Typically, these devices are used, if at all, on limited production or specialty engines.

Accordingly, it is an object of the invention to overcome the limitations and disadvantages of prior art devices and provide a reliable mechanism which achieves selectable valve timing over the entire engine speed range. It is a further object of the invention to provide a mechanism for selectable valve timing that is effective to increase engine output and fuel economy and is reliable. It is also an objective of the invention to provide a valve control mechanism for internal combustion engines which overcomes the complexity of the prior art devices and is simple to manufacture, implement, and use. It is still further object of the invention to provide a selectable valve timing mechanism that can be retrofitted onto existing internal combustion engines without major modifications of the existing engine structure. Finally, it is an object of the invention to provide a mechanism that is effective in apparatus requiring variability of valve-like activation.

SUMMARY OF THE INVENTION

Generally, the present invention provides a valve timing mechanism that provides adjustable valve timing. The valves are typically the intake and exhaust valves of an engine, but there is no limitation as to the type of valves to which the invention is applicable; however, the invention is most appropriately used in the context of periodic valve operation where adjustability is desirable.

The valve timing mechanism comprises a guide assembly which is adapted to fit onto or be integrated into a conventional internal combustion engine. The guide assembly preferably includes an upper guide surface and mounting surface spaced apart from the upper guide surface. A pair of longitudinal guide members are included to contain undesired movement or lash. The guide assembly can be integrated into the engine's cylinder head, integrated in part with the cylinder head or made as an independed housing. Positioned within the guide assembly is a valve activator which is operably connected to a valve to be controlled. Normally this is a valve stem or roller follower on the valve or valve stem and is used to move the valve between first and second positions typically between open and closed positions of the engine cycle.

The valve activator includes an angled contact surface and a first and second continuing contact surfaces offset from the angled contact surface. The contact surface is positioned at an angle greater than zero but less than 90° to a normal from the first and second continuing contact surfaces. The valve activator angle is preferably selected for the desired operation of the valve and is generally less than 45° for efficient opening and closing. The valve activator includes a pair of stop surfaces that are preferably parallel to each other to engage opening and closing stops positioned within the guide assembly.

The valve timing mechanism also includes a drive ram which is positioned within the guide assembly and in contact with the valve activator. The drive ram includes an angled drive surface and a pair of offset, preferably parallel, continuing surfaces for engaging and travelling along the contact surfaces of the valve activator. The first and second offset continuing drive surfaces are positioned at either end of the angled drive surface. The first surface is designed to contact the first continuing contact surface of the valve activator. The drive ram is preferably moved in a linear, reciprocating manner by a drive which is synchronized with the operation of the engine either mechanically or electrically. The angled contact surfaces of the valve activator and drive ram may be of complementary angles but are preferably a degree or two different to facilitate respective travel therealong. The contact between the angled drive surface of the drive ram forces the angled contact surface of the valve activator to move in a direction generally normal to the drive ram as the valve is changed from a closed to open position. As the drive ram is retracted, the valve biasing mechanism forces the valve activator to move in the reverse direction to change the valve from an open to a closed positioned.

While both the valve activator and the drive ram include preferably angular contacting and drive surfaces, respectively, it is to be understood that the angle may be curvilinear as well as linear. For example, the leading contact edges can be curved or rounded to permit the drive to ride over the valve activator and force the valve to open. In certain applications, the use of curvilinear surfaces provides an advantage over the rectilinear surfaces of the preferred embodiment.

The drive means for the drive ram is preferably any mechanism that imparts a reciprocating motion to the drive ram. One preferred mechanism comprises a rotating shaft having an eccentrically mounted bearing surface for driving connection with the drive ram. The rotating shaft is preferably connected to the crankshaft or other means which can drive the shaft in a manner that is responsive to the engine's cyclical operation. A preferred mechanism for connecting the rotating shaft to the crankshaft is a belt or drive chain. Numerous other drive means are available for driving the ram such as electronically synchronized solenoids. The utilization of these other means will depend upon the application to which the valve timing mechanism is to be used. Use in internal combustion engines favors utilizing as many existing components as possible to reduce the number of changes in overall engine design required to accommodate the invention. However, where a totally new engine is to be produced it may not be necessary to use existing timing or control functions to fully take advantage of the invention and achieve cost efficiencies.

The mechanism of the present invention includes opening and closing stop means within the guide assembly. These stops are essential elements of the invention and are used to control the degree of movement of the valve activator. In one preferred embodiment of the invention, the opening stop is used to control the valve opening and the closing stop is used to control the valve closing. These stops are configured to contact the first and second stop surfaces of the valve activator. While the locations of the first and second stops may be fixed for a particular engine operation or condition, it is a preferred feature of the invention that the position of each stop be adjustable.

In the preferred embodiments of the invention, the stops are adjustable within the guide assembly so that adjustments can be made to each stop independently of the other. In another embodiment, the adjustments can be made simultaneously and in a predefined relationship to each other. The adjustments to the stop positions can be manually made by means of set screws, thumb screws, or electronically by one or more step motors or the like. By adjusting the locations of the stops, the timing of the valve opening and closing can be selectably controlled over an extremely broad range. More importantly, these adjustments can be made during the operation of the engine so that electronic feedback from the engine can be used to control or vary the timing of the engine to accommodate changes in operating conditions or requirements.

The present invention provides significant improvements in engine control and valve timing contrasted to the prior art. The invention also affords infinite control over valve opening and closing to provide effective control over emission from the engine, fuel economy and power. The invention also provides for the individual control of exhaust and intake valve openings, either manually or automatically. Other advantages of the invention will become apparent from a perusal of the following detailed description of presently preferred embodiments of the invention taken in connection with the drawings.

PRESENTLY PREFERRED EMBODIMENTS

Figure 1:
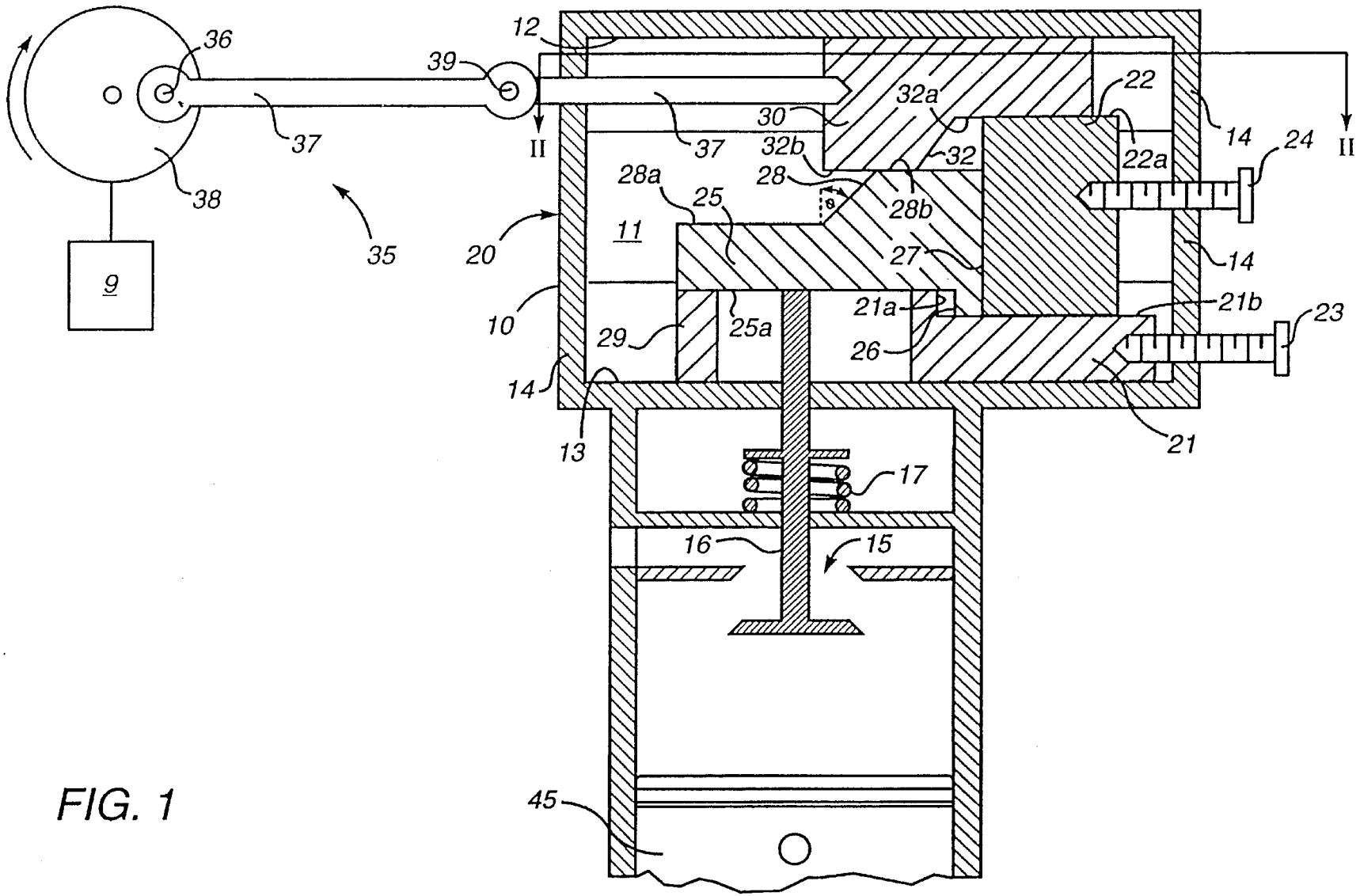
FIG. 1 is a sectional elevation of the valve mechanism of the present invention.

Referring to FIG. 1 an embodiment of the invention is shown for illustrating the operation of the variable valve timing mechanism 20. Valve timing mechanism 20 includes a guide assembly 10 which can be made as a separate housing for retrofitting onto an existing engine or it can be integrated into the engine cylinder head design of an engine incorporating the invention. With respect to the description of a present embodiment of the invention, and those shown with respect to FIGS. 4–11 the guide assembly is shown as a housing incorporating the elements of the guide assembly and a valve cover. Also, the variable valve timing mechanism of the invention is shown applied to a typical internal combustion engine using traditional poppet intake and exhaust valves. However, it is to be understood that the invention can be incorporated into other various engine and valve arrangements where adjustability is desired.

Figure 3:
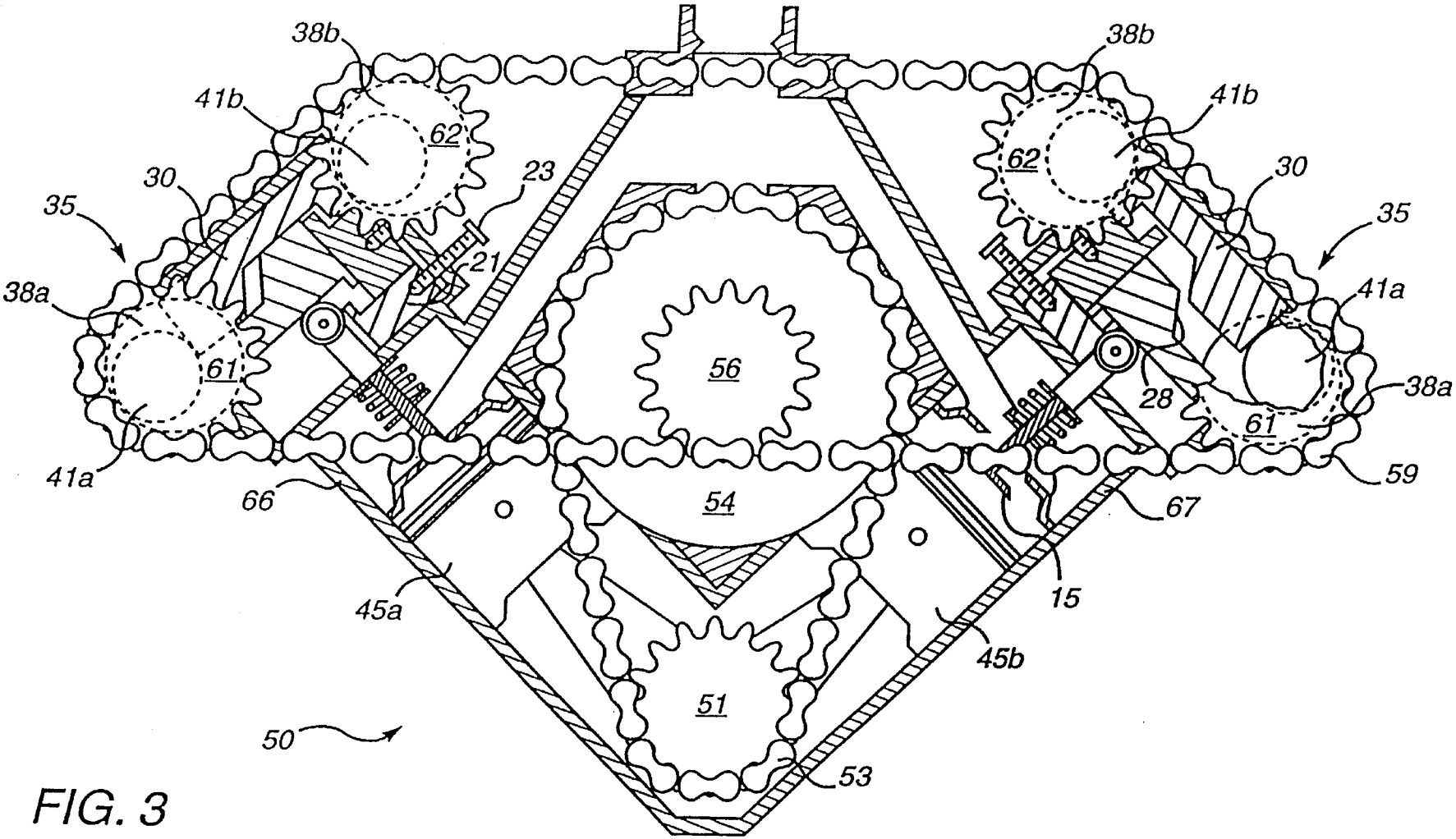
FIG. 3 is an elevation, in partial section and breakway, of engine retrofitted to include the valve mechanism of the present invention and utilizing the engine's crankshaft as the mechanisms drive.

Generally, guide assembly 10 comprises a pair of spaced apart longitudinal side guides 11 and support risers 14 for supporting guides 11. Supports 14 can be integrated into the engine cylinder head to supportingly position the longitudinal and surface guides. Assembly 10 includes an upper surface guide 12 and base 13 spaced apart but in preferably parallel relationship to each other. Upper surface guide 12 can be designed to span a bank of valve mechanisms and supported by risers 14 and integrally formed in the cylinder head. As shown, base 13 is preferably the top of the engine cylinder head. Upper guide surface 12 and base 13 are made of a rigid material such as iron or machine tool grade steel, and the side guides can be made from any rigid material but are preferably of the same material as upper guide 12. Guide assembly 10 is designed to fit as a replacement for the engine cylinder head of an existing cylinder block as shown in FIG. 3. Base 13 includes openings through which the valve stems 16 of valves 15 extends. Positioned on the bottom of base 13 is valve spring 17 or other means for preferably biasing the valve in the closed position. Located within longitudinal side guides 11 and on base 13 is valve timing mechanism 20.

Valve timing mechanism 20 comprises closing stop 21 which is positioned on base 13 and opening stop 22 which is shown as located on closing stop 21. Closing stop 21 controls the timing of the valve closing. Closing stop includes flange 21*a* which includes a stop surface and a perpendicular contact surface 21*b* for slidably supporting the valve activator. The position of opening stop 22 is responsible for controlling the timing of the opening of the valve. Opening stop 22 includes a support surface 22*a* adapted to permit sliding support of a drive ram. The space between support surface 22*a* and upper surface guide 12 is preferably about the same as the drive ram. Where timing is to be fixed or opening and closing of the valve are not desired to be independent of one another, stops 21 and 22 can be a single or integrated unit. In a fixed arrangement, stops 21 and 22 are fixedly mounted to base 13. If valve timing is to be adjustable, then integrated stops 21 and 22 are adjustably mounted to base 13 by means of an adjuster, such as those described hereinafter. By so limiting the stop means as described above, the full advantage of the present invention is not achieved.

As shown in FIG. 1, opening stop 22 is adjustably mounted on closing stop 21 which itself is adjustably positioned on base 13. Stop 22 may also be positioned independently of stop 21, however, as shown, the size and compactness of mechanism 20 is achieved. As shown, stops 21 and 22 include adjusters 23 and 24, respectively. Adjusters 23 and 24 can be set-screws with thumb knurl which can be manually turned to independently position the stops relative to each other. As will be appreciated, the adjusters can be operably connected to step motors which can control their respective setting or which settings can be controlled relative to each other. Also, each of the closing stops 21 in an engine can be operably connected to each other for synchronous timing control of all valve closing cycles. Likewise, all opening stops 22 in an engine can be synchronously controlled. These controls are most desirable programmed into the engine management control module 9 or its cpu.

Figure 2:
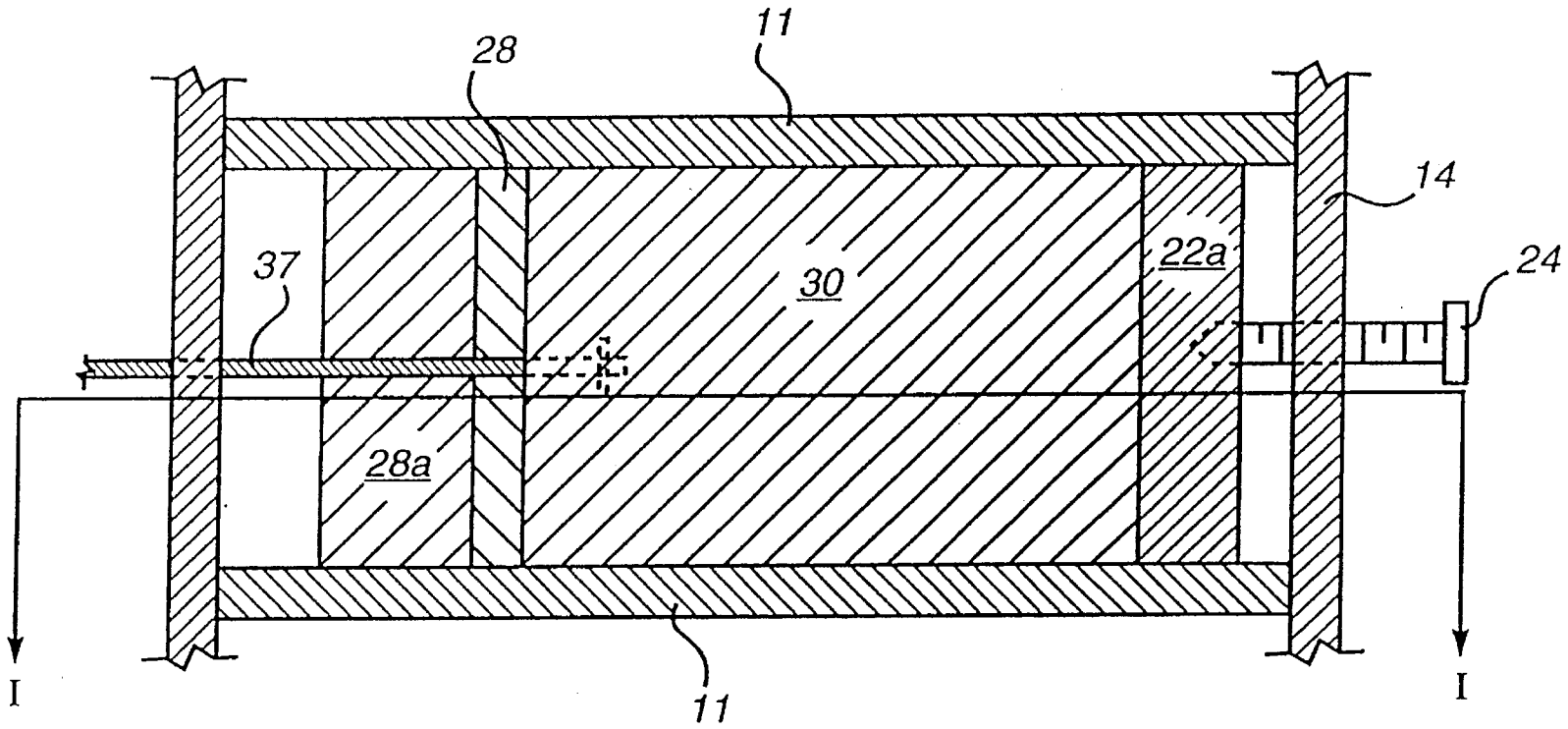
FIG. 2 is plan view of the valve timing mechanism of FIG. 1.
Figure 2A:
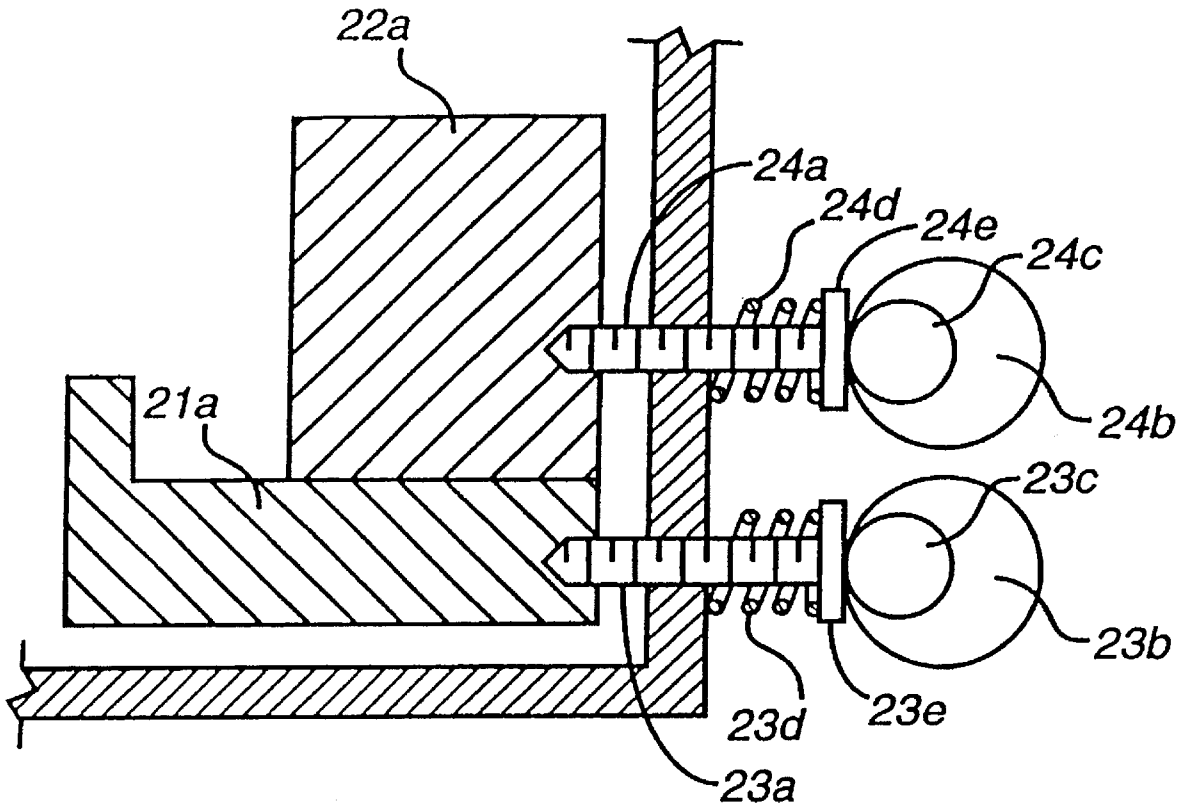
FIG. 2*a* is an illustrative view of a means for adjusting the position of the stops.

FIG. 2*a* is an illustration of an arrangement wherein adjusters 23*a* and 24*a* are mounted on the associated stops 21*a* and 22*a* and in contact with eccentrics 23*c* and 24*c*, respectively. Eccentrics 23*c* and 24*c* are mounted upon shafts 23*b* and 24*b*, respectively, which are connected to associated step motors (not shown) for independent rotation and control. Alternatively, shafts 23*b* and 24*b* can be interdependently controlled by gearing the shafts together and utilizing a single step motor or control activator. Biasing means 23*d* and 24*d* are shown interposed between support 14 and eccentric follower 23*e* and 24*e*. Other nonmanual means for positioning stops 21 and 22 may be used provided such positioning is accurately controllable since only small changes are necessary to achieve a large variation in timing change.

Valve timing mechanism 20 also includes valve activator 25 having a first and second stop surface 26 and 27, respectively. First surface 26 is configured to abut closing stop 21 and flange 21*a*. In this embodiment, first surface 26 comprises a depending flange which is adapted to slide on the upper surface 21*b* of stop 21 and engage flange 21*a*. Second surface 27 is adapted to abut opening stop 22. Valve activator 25 also includes a contacting surfacing 28 which is inclined at an angle $\phi$ of from about greater than 0° but less than 90° to a line normal to surface 28*a*; however, it is preferable that the angle be less than 60° and most preferable that the angle be from about 5° to 20°. Continuing contact surfaces 28*a* and 28*b* of contact surface 28 provide a sliding contact surface for a drive ram which moves valve activator 25 in response to the crankshaft operating position. Continuing surfaces 28*a* and 28*b* extend on either side of contact surface 28 and are preferably planar and parallel to each other, but offset by contact surface 28. The bottom surface 25*a* of valve activator 25 contacts valve stem 16 for activation of the valve or a roller follower can be used in a typical engine configuration (See FIG. 3). It has also been found desirable, but not necessary, to include stabilizer 29 on base 13 to stabilize the sliding movement of valve activator 25 which is slidingly supported thereby. In this case, bottom surface 25*a* preferably slides over stabilizer 29 during its motion in opening and closing the valve; however, when valve 15 is closed, valve activator 25 is spaced apart from stabilizer 29.

Continuing surfaces 28*b* and to some extent 28*a* are lengthened to achieve the desired degree of adjustability of timing. Also, these surfaces are related to the stroke of an internal combustion engine if used in such an application. The continuing surfaces can be eliminated if control over duration of the valve opening or closing is not required.

A drive ram 30 is used to slidingly engage valve activator 25. Ram 30 includes an angled drive surface 32 which is inclined preferably at an angle which is complimentary to contacting surface 28 of valve activator 25; however, it has been found that a degree or two of difference between the angles of the respective angled surfaces reduces wear. While interlocks have been used between the respective surfaces 32*b* and 28*b*, they have not been found to be particularly useful. Drive ram 30 includes a pair of continuing surfaces 32*a* and 32*b* respectively, which are offset from contact surface 32 and designed to slide on like surfaces 28*a* and 28*b* of valve activator 25. Surfaces 32 and 32*b* are used to drive surface 28, 28*a*, and 28*b* of activator 25. As drive ram 30 is moved in a reciprocating motion, drive valve activator 25 is moved in both a horizontal and vertical direction in cooperation with valve biasing member 17 to open and close intake and exhaust valves. Ram 30 is also constrained to slide within guide assembly 10 against upper guide surface 12 and guides 11. Drive ram 30 slidingly engages valve activator 25 and is preferable of a conforming shape to that of the activator, including having a substantially complimentary angled surface.

Continuing surfaces 32*b* and to some extent 32*a* are lengthened to achieve the widest degree of variability in valve timing. Generally, the shorter continuing surface 32*b* (and continuing surface 28*b*) the smaller the potential range of timing variability. For the normal internal combustion engine, the normal range of timing variability is between about 0° and 30°. Unlike prior art devices which provide one or two timing options, the present invention can be varied over the entire range selected. If the continuing surface 32*b* is eliminated, the control over the duration of the valve opening is significantly reduced.

In operation, the movement of drive ram 30 is constrained within a loose relationship between valve activator 25 and upper guide surface 12 and longitudinal guides 11 during reciprocation. Notwithstanding this somewhat loose fit between the parts, no appreciable wear takes place when ram and valve activators are fabricated from the machine tool grade steels. Even aluminum has shown very little wear as long as sufficient oil is supplied to valve timing mechanism 20. As shown in FIG. 1, drive 35 is connected to drive ram 30 by means of drive rod 37. As shown in the present embodiment, drive 35 comprises a rotating shaft 38 to which drive rod 37 is eccentrically connected at point 36. While shown as a rotating shaft, drive 35 can be an electrical drive such as a solenoid or mechanical activated linear drive. Rotating shaft 38 is similar in function to the cam shaft of the typical internal combustion engine and would be most conventionally used in the embodiment shown in FIG. 3. Where the invention is to be retrofit into an existing engine, the rotating shaft can be connected to the crankshaft in a manner similar to the replaced cam shaft. However, it should be clear that the manner of operating and controlling drive 35 and the nature of the drive is entirely discretionary with the user and the type of engine and engine control unit. In most engines operation and control preferentially would take advantage of the mechanical linkage between the crankshaft and the drive such as by belt or chain drive. In engines using a computer control drive 35 can be independent, and the operation and control can be separate from a mechanical connection between the crankshaft and the drive.

Rod 37 is preferably articulated and includes pivot 39. Pivot 39 is shown on rod 37, but can be the connection between rod 37 and drive ram 30. Rotation of drive shaft 38 causes rod 37 to reciprocate and move drive ram 30. As rod 37 moves toward the eccentric position 36 closest to the valve timing mechanism, ram 30 forces valve activator 25 to move in a linear direction perpendicular to the motion of the valve stem. This motion is caused by drive surface 32 of drive ram 30 contacting contact surface 28 of valve activator 25. This linear motion continues until valve activator surface 27 contacts opening stop 22. When the linear motion of the valve activator is impeded by the stop, the surface inclinations of the drive ram and valve activator surfaces slide across each other so that valve activator 25 is forced in a direction perpendicular to its previous travel, but parallel to the direction of valve travel. Drive ram 30 will reverse direction upon the eccentric point 36 on the shaft moving away from guide assembly 10. Valve activator 25 also moves in a linear direction parallel to the travel of drive ram 30 by reason of the compressive forces between the two caused by the valve biasing member 17. Valve activator 25 continues in the same direction as ram 30 until it reaches closing stop 21 and, in particular, flange 21*a*. At this point valve activator 25 stops its linear motion and ram 30 moves so that angled drive and contact surfaces 32 and 28, respectively, come into contact. It should be noted that in actual operation the contact between the angled surface is almost instantaneous when driven by ram 30 or bias member 17. In this case, the valve biasing member 17 forces valve activator 25 to move perpendicular to the travel of ram 30 and away from base 13. As it does, valve 15 closes and the cycle starts over.

As can be seen, by adjusting opening stop 22, the distance between the stop and valve activator 25 is varied to cause changes in the timing of valve opening. By adjusting the position of opening stop 22, valve 15 can be adjusted to open prior to piston 45 reaching top dead center ("TDC") or later, for example, after top dead center ("ATDC"). In fact, the opening of valve 15 can be set for any crank angle desired. Accordingly, moving stop 22 towards valve activator 25 causes an earlier valve opening and moving it away delays the valve opening. With respect to closing stop 21, moving the stop away from valve activator 25 causes an earlier closing of the valve and moving it closer to valve activator 25 delays the valve closing.

Referring to FIG. 3, a presently preferred embodiment of the invention is shown as a diagrammatic sectional elevation to illustrate a possible configuration of the present invention retrofitted onto an existing engine 50. In this case, engine 50 is shown as a typical V-6, V-8, V-10 or V-12. It is to be understood, however, that engine 50 can be any type of engine including an in-line engine, two- or four-stroke or the like. Engine 50 is shown with piston 45*a* in the compression cycle and piston 45*b* in the intake cycle, with the intake valve fully opened.

Figure 3A:
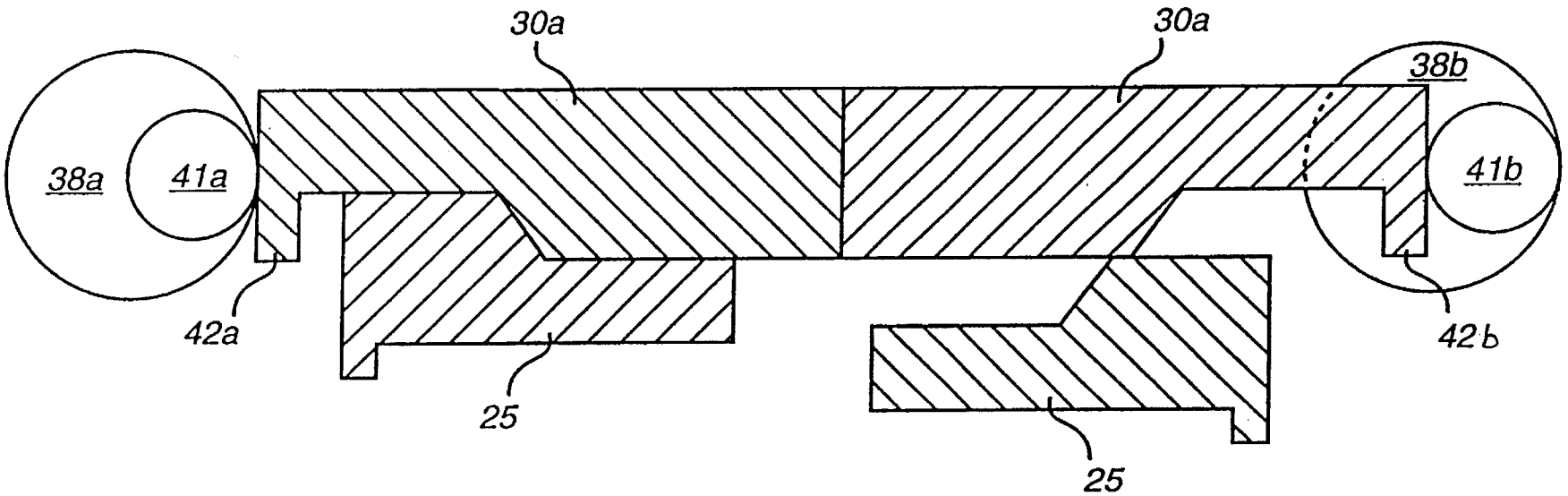
FIGS. 3*a–d* are illustrative view of other drive arrangements which are useful in two or four valve cylinder engines.
Figure 3B:
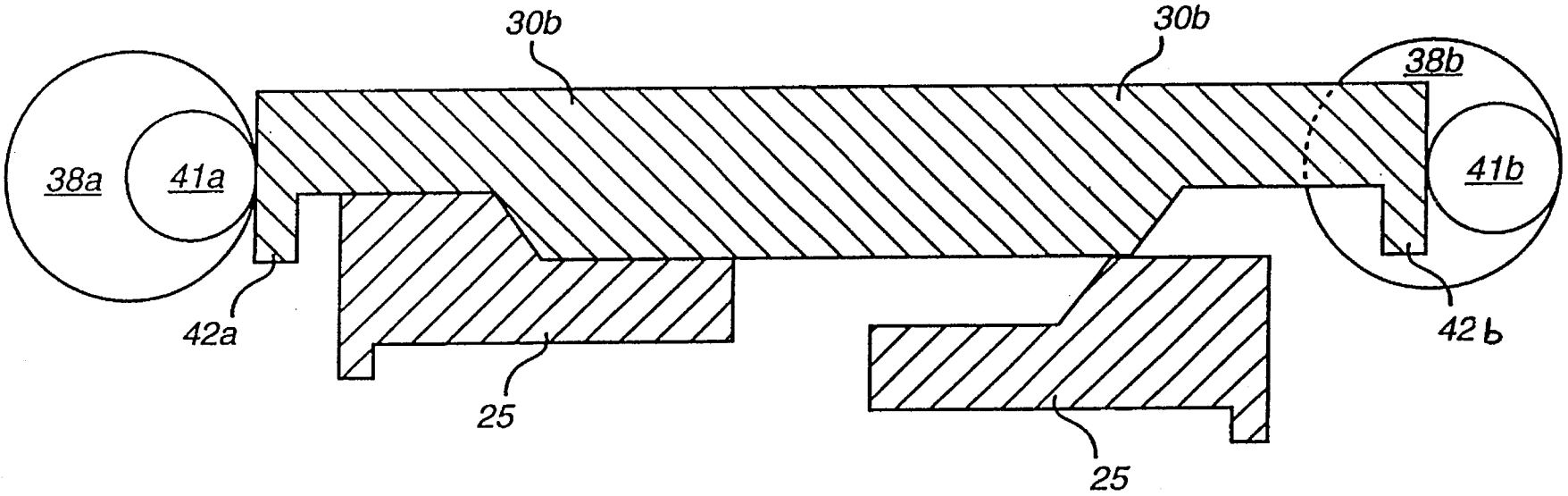
Figure 3C:
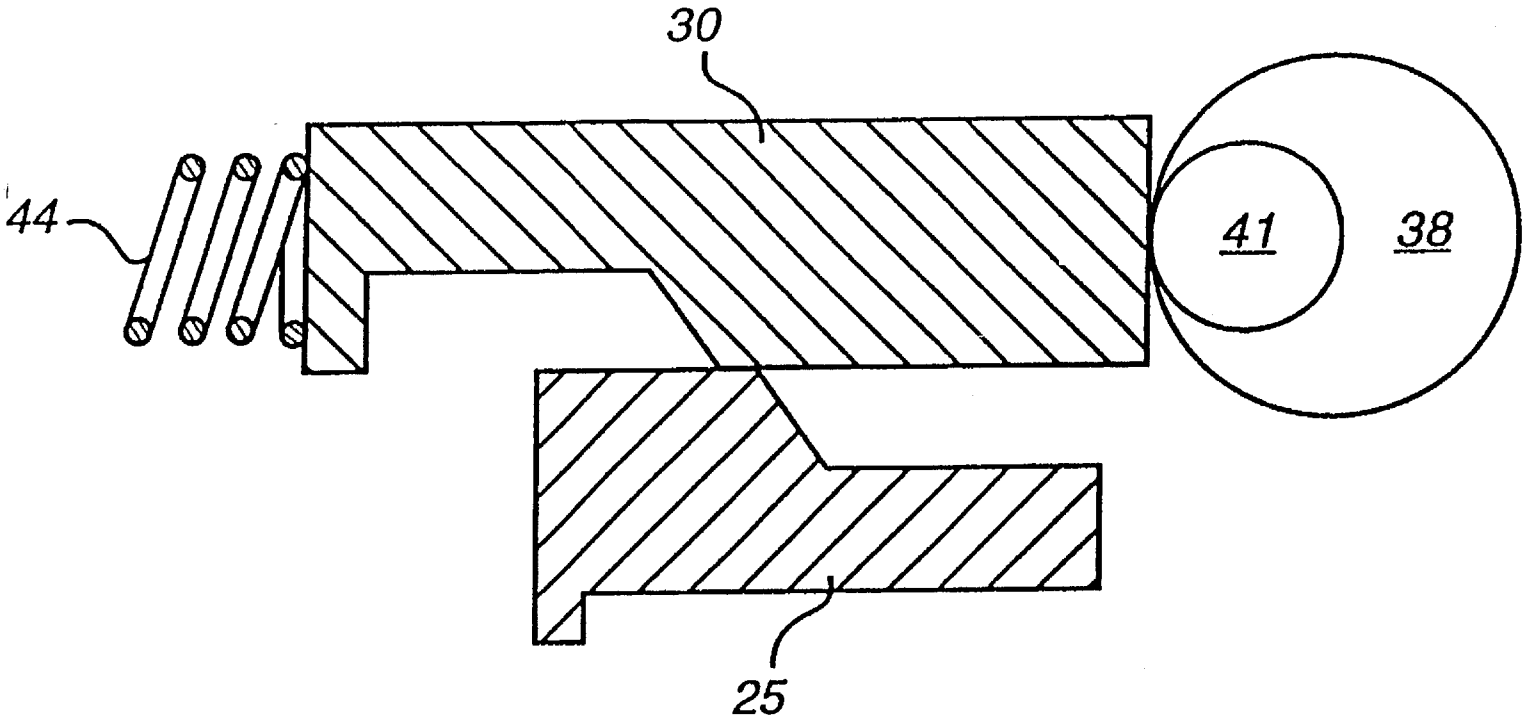
Figure 3D:
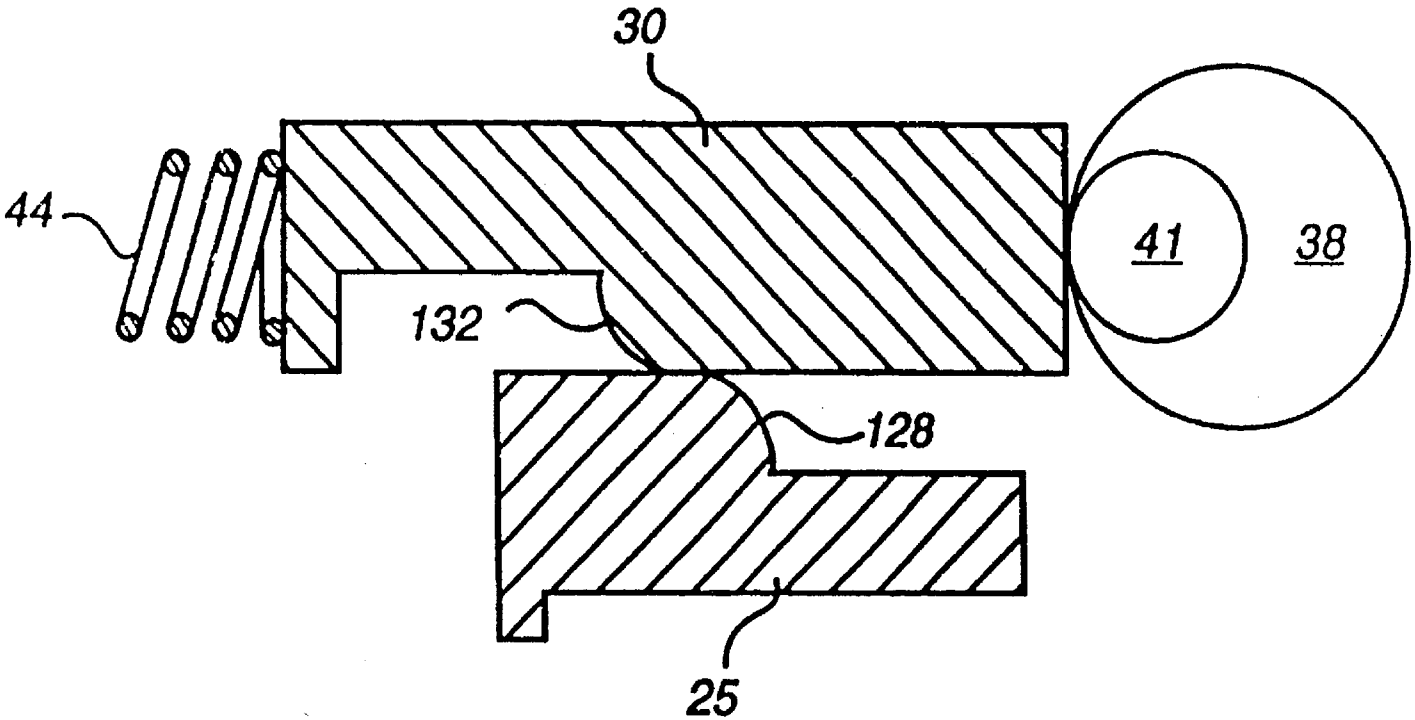

Engine 50 includes a crankshaft attached to sprocket 51 which has timing chain 53 entrained about it. Timing chain 53 is also entrained about idler sprocket 54 which includes valve drive sprocket 56. As shown in FIG. 3, drive chain 59 is entrained about a pair of driven sprockets 61 and 62 which control rotation of rotating shafts 38*a* and 38*b*, respectively. One pair of driven sprockets and shafts are positioned on each bank of cylinder heads 66 and 67. In a preferred embodiment (as shown in FIGS. 3*a* and 3*b*), drive 35 comprises rotating shafts 38*a* and 38*b* having mounted thereon eccentric roller drives 41*a* and 41*b*, respectively. Eccentric drives 41*a* and 41*b* contact drive rams 30. Ram 30 (or 30*a*) includes abutment surfaces 42*a* and 42*b* which are in contact with eccentric roller drives 41*a* and 41*b*, respectively. If a single ram is used, a bias element 44 can be used to maintain contact with an eccentric, see FIG. 3*c* for example. In this case, only rotating shafts 38 drive ram 30 are required and rods 37 are eliminated.

In FIG. 3*a* and 3*b* an exploded view of alternate drive rams 30 are shown wherein the eccentric roller drives 41*a* and 41*b* of rotating shafts 38*a* and 38*b* operate both the intake and exhaust valves. In FIG. 3*a*, rams 30*a* abut each other while in FIG. 3*b* a single ram 30*b* drive two valve activators 25. The embodiments shown in FIGS. 3, 3*a*, and 3*b* show that numerous variations of the invention which can be used to advantage.

To better understand the advantages of the present invention, illustrative embodiments have been set forth in FIGS. 4–11 which utilize two different load requirements that an engine would encounter during operation. FIGS. 4, 6, 8 and 10 illustrate idle, coasting or other light loads while FIGS. 5, 7, 9 and 11 illustrate heavy loads or high performance. All Figures illustrate the intake stroke of engine; however, the exhaust stoke would be similar. In each of the Figures, like reference numerals refer to like elements of valve timing mechanism 20.

Figure 4:
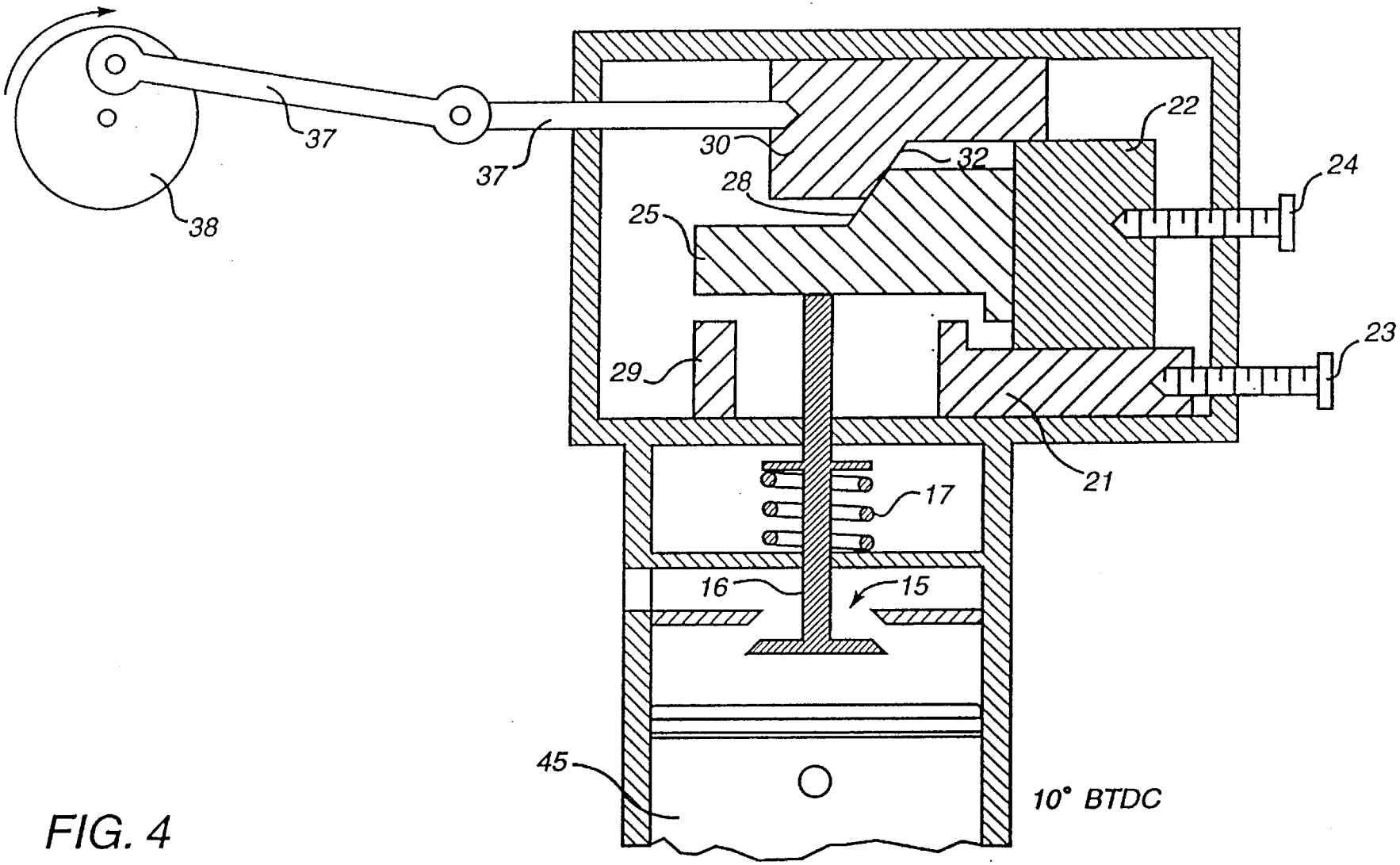
FIGS. 4–11 are sectional elevations of the valve mechanisms illustrating the intake stroke at various degrees of crank angle.
Figure 5:
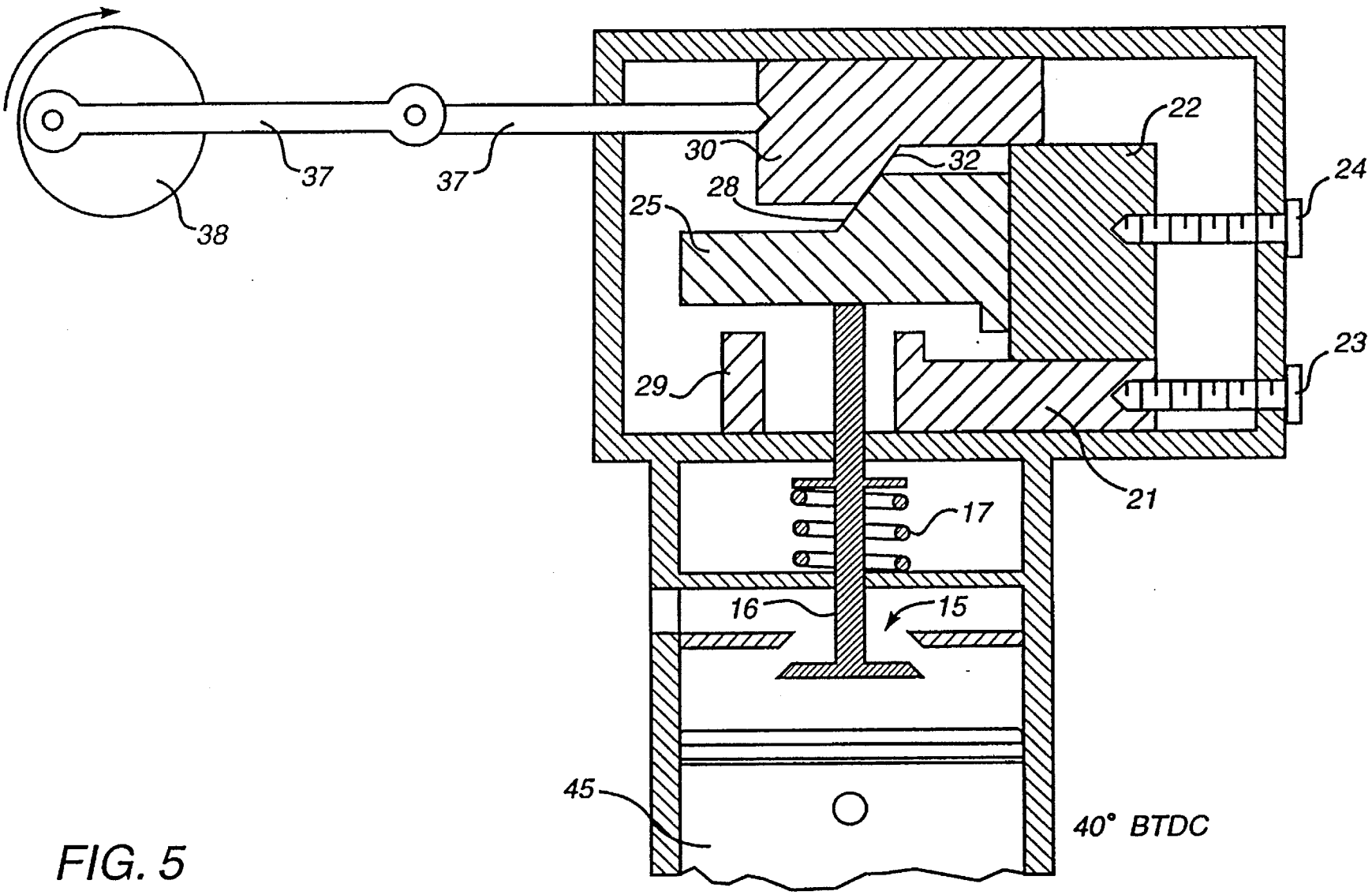

With respect to FIG. 4, valve 15 is shown beginning to open. Piston 45 is shown at 10° BTDC (before top dead center) for a light load. Referring to FIG. 5, piston 45 is shown at 40° BTDC where intake valve 15 is just beginning to open. This setting is for high performance and is to be contrasted to FIG. 4 where the setting is for light loads. As can be seen, both opening stop 22 and closing stop 21 have been repositioned towards valve stem 16.

Figure 6:
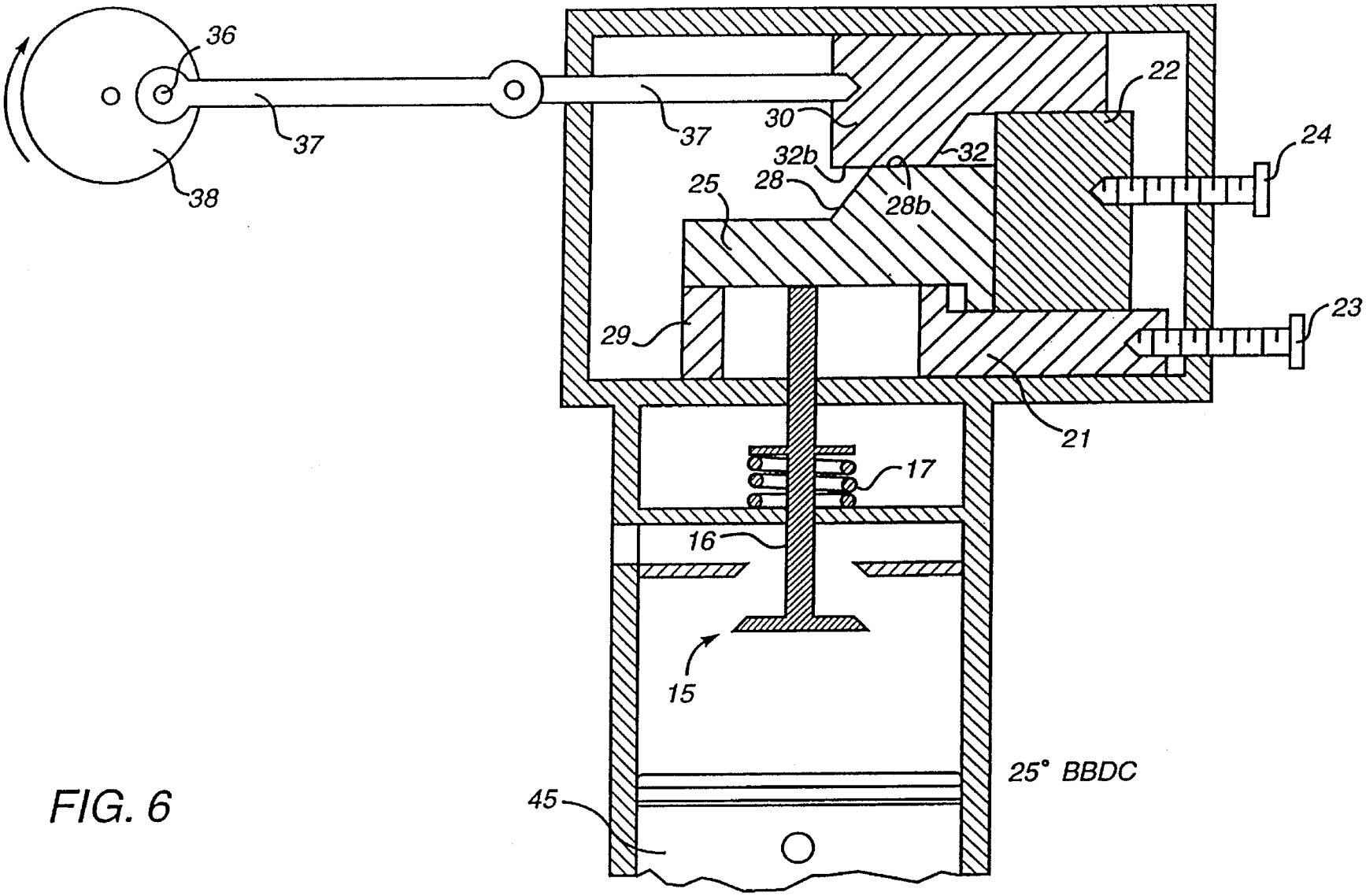
Figure 7:
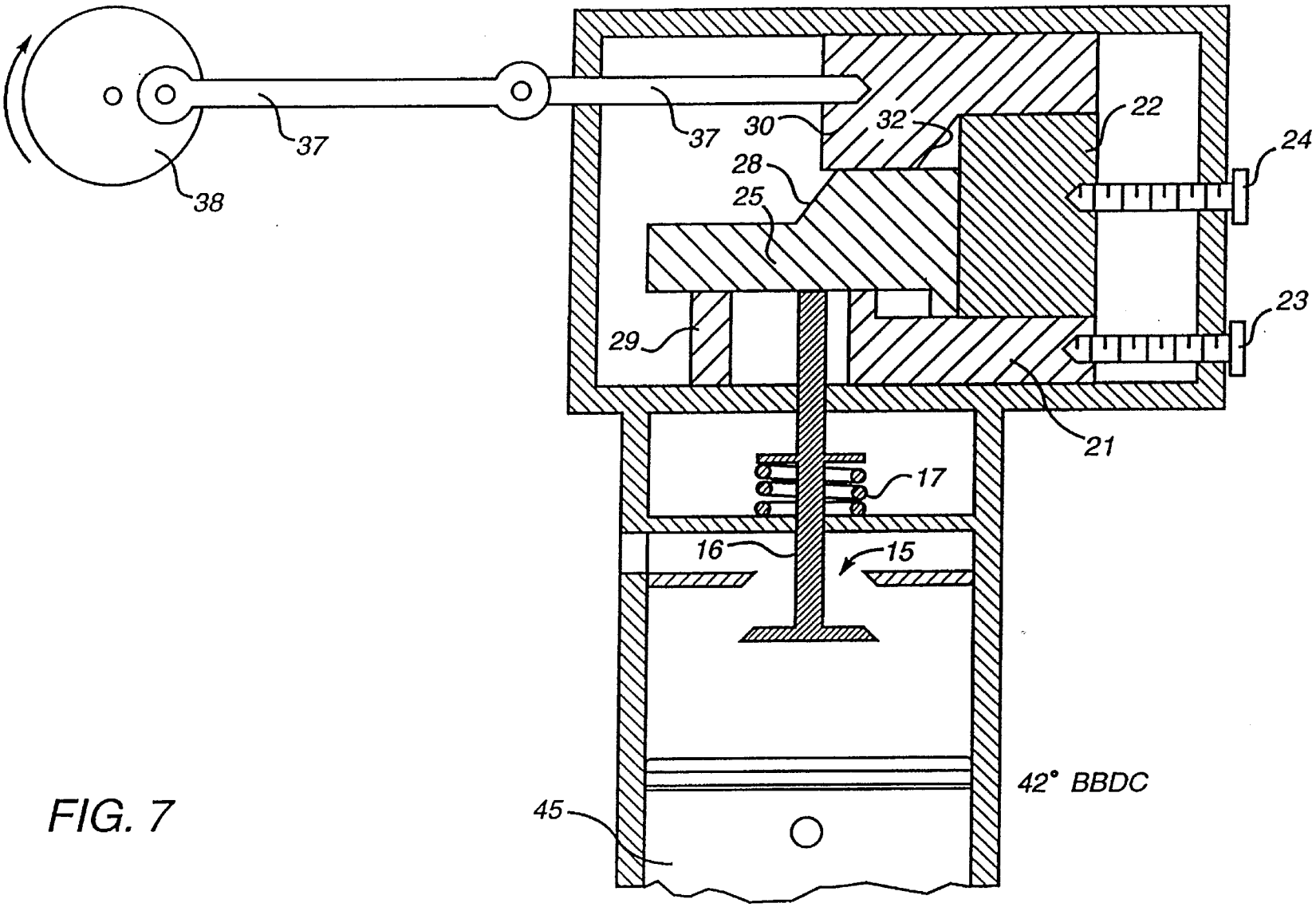

Referring to FIGS. 6 and 7, FIG. 6 shows a light load intake stroke with the intake valve fully open. Piston 45 is shown at 25° BBDC (before bottom dead center). As can be seen, the eccentric position of rod 37 on rotating shaft 38 is fully extended to drive ram 30 toward opening stop 22. Surface 32*b* of ram 30 is riding on continuing contact surface 28*b* to fully open valve 15. In this embodiment, both stops 21 and 22 are positioned away from valve stem 16. This is to be contrasted with FIG. 7, a high performance intake stroke wherein piston 45 is positioned at 42° BBDC. Again rod 37 and rotating shaft 38 are positioned to provide maximum valve opening. Both closing and opening stops 21 and 22, respectively have been positioned towards valve stem 16, however, it should be noted that the relative positioning of the two stops is different from the setting shown in FIG. 6.

Figure 8:
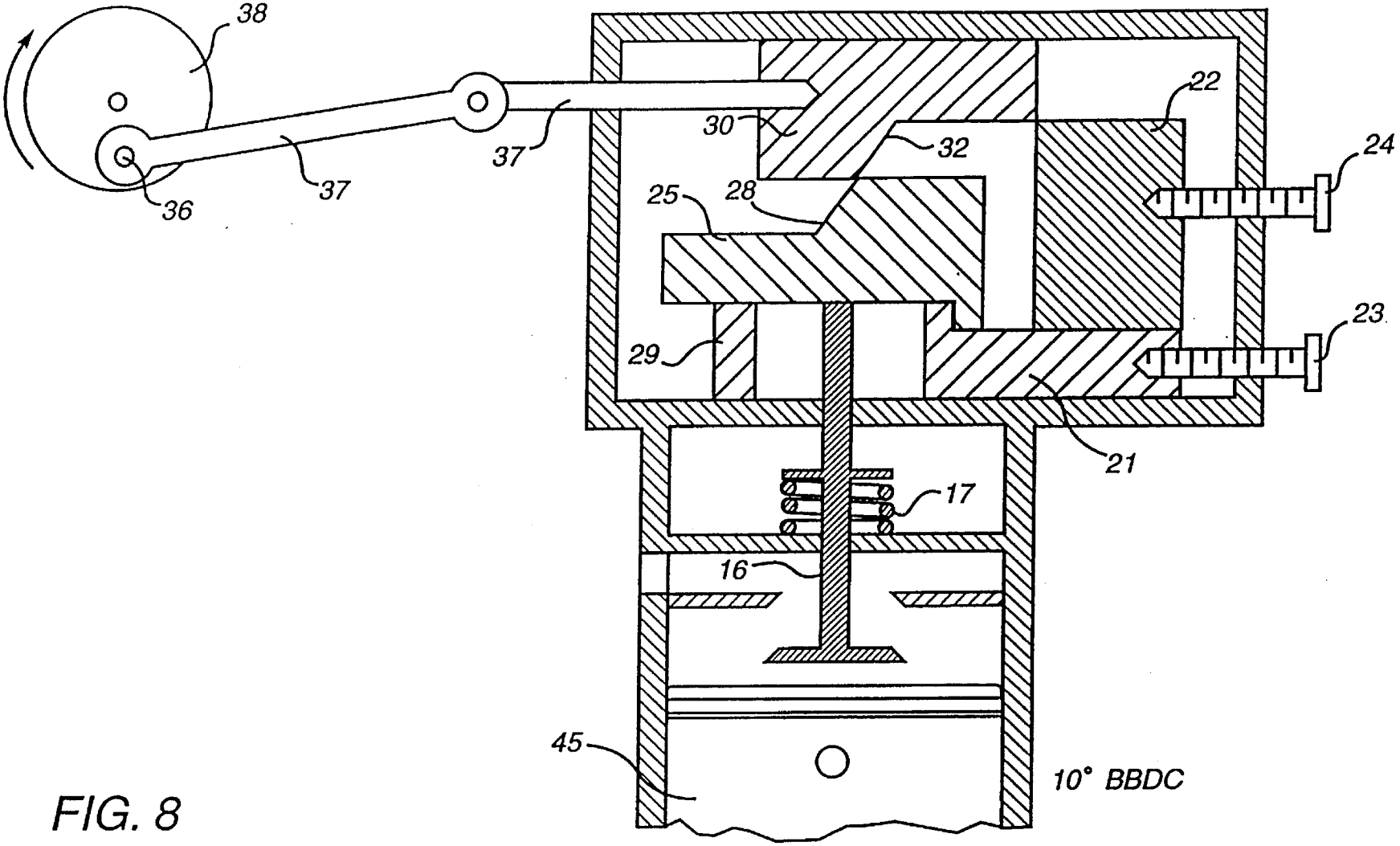
Figure 9:
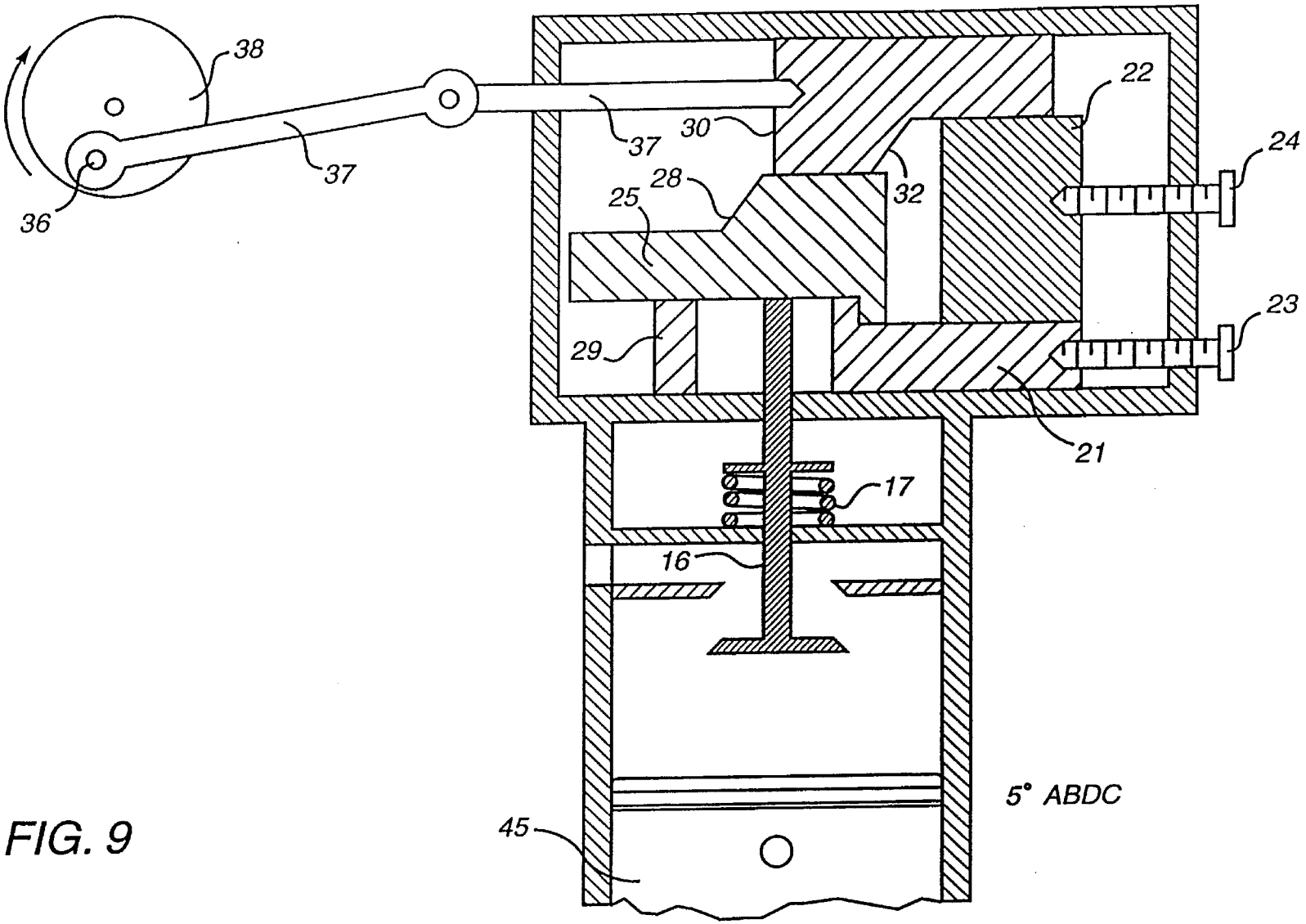

With reference to FIGS. 8 and 9, FIG. 8 shows intake valve 15 immediately prior to starting to close as rotating shaft 38 and rod 37 move towards a fully extended position. Both stops 21 and 22 have been adjusted to be set away from stem 16. Piston 45 is shown at 10° BBDC. FIG. 9 on the other hand, shows the intake stroke with valve 16 at full open for high performance where the piston is at 5° ABDC. The stop settings have been moved towards the valve stem.

Figure 10:
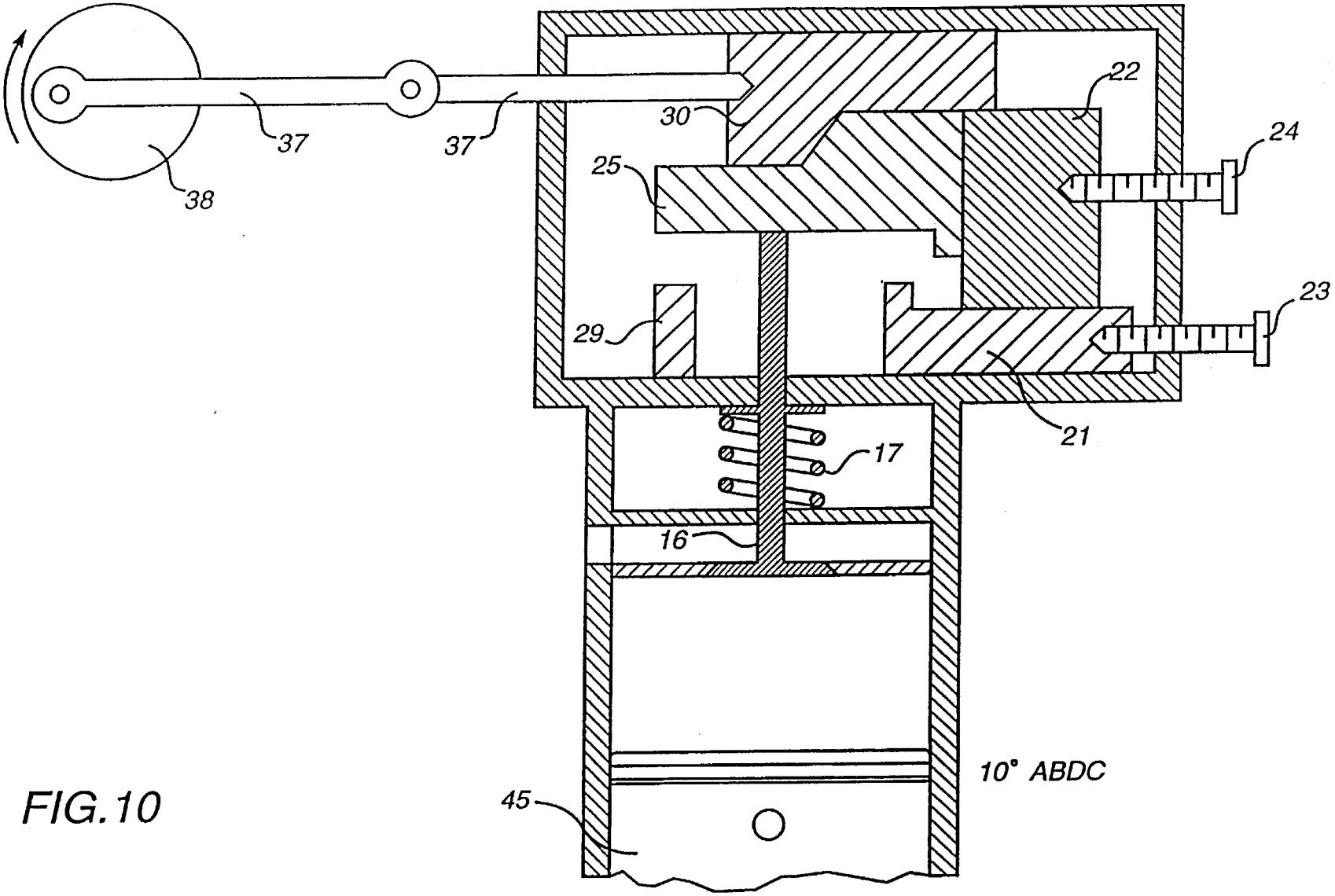
Figure 11:
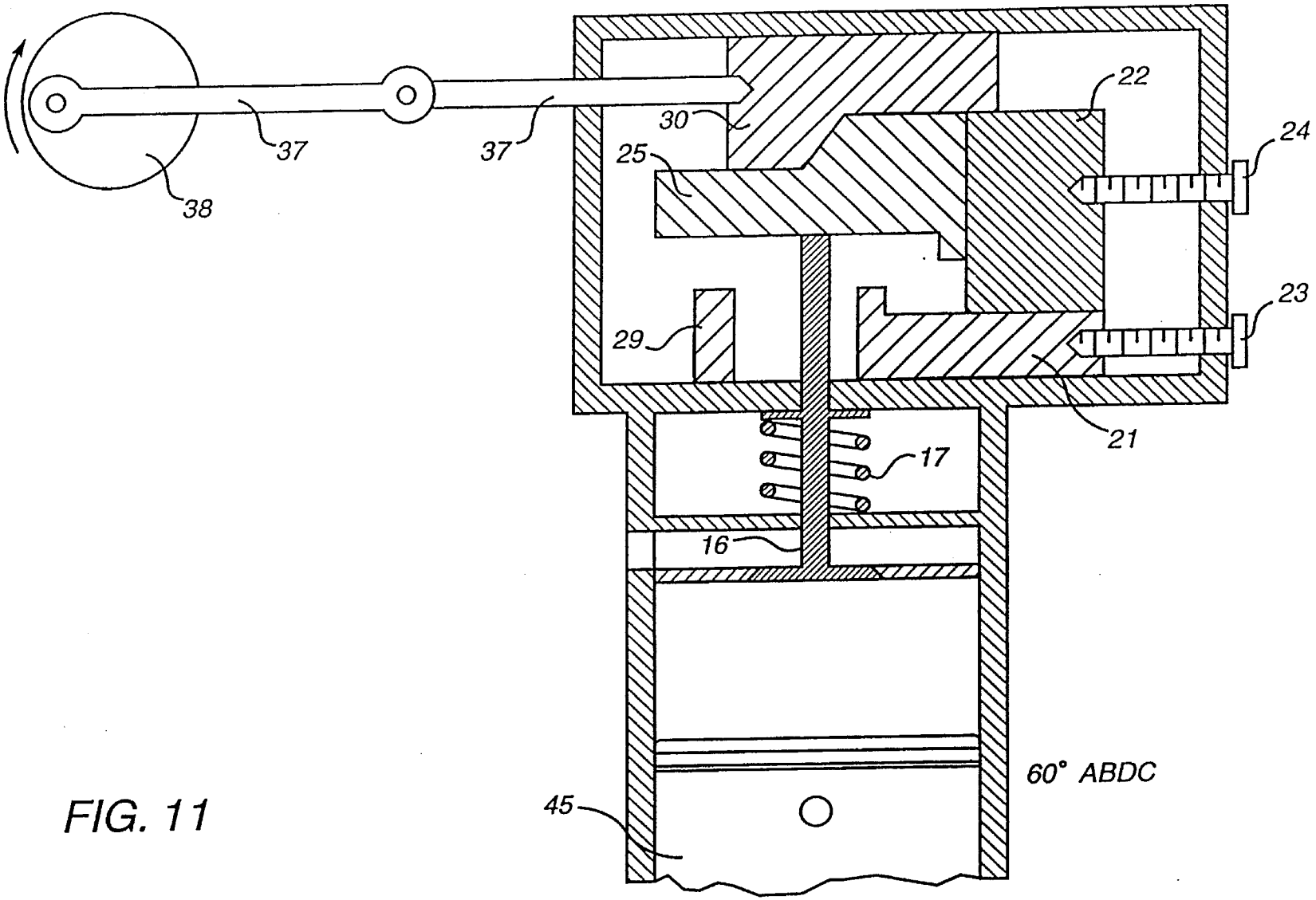

Finally, FIGS. 10 and 11 show piston 45 at 10° ABDC and 60° ABDC respectively. In both cases rod 37 is fully extended and intake valve 15 is shown fully closed. Valve activator 25 is shown positioned against opening stop 22. As can be seen, valve activator 25 does not contact closing stop 21 in this position.

The illustrative embodiments of the invention shown in FIGS. 4–11 demonstrate the advantages the valve timing mechanism of the present invention. However, it is clear that the invention affords numerous parameter to vary to achieve the desired adjustment in operability. Thus, while presently preferred embodiments of the invention have been shown and described in particularity, the invention may be otherwise embodied within the scope of the appended claims.

What is claimed is:

1. A variable valve timing mechanism for controlling at least one biased valve comprising a. a guide assembly having a mounting surface and a spaced apart upper guide surface, said assembly including spaced apart longitudinal guides, b. a closing stop positioned on said mounting surface and having a stop surface;

c. an opening stop positioned on said guide assembly and having a stop surface;

d. a valve activator movably positioned within said guide assembly and in operable contact with said biased valve, said valve activator having first and second stop surfaces to contact a respective closing stop and opening stop, and an angled contact surface positioned thereon;

e. a drive ram movably positioned within said guide assembly and in contact with said upper guide surface and said valve activator, said drive ram having an angled drive surface positioned for contacting said contact surface of said valve activator, and f. a drive connected to said drive ram for imparting reciprocating motion thereto, said drive being synchronized with the operation of said valve.

2. A variable valve timing mechanism as set forth in claim 1 wherein said valve activator includes first and second continuous surfaces offset from said angled contact surface.

3. A variable valve timing mechanism as set forth in claim 1 wherein said angled contact surface of said valve activator is curvilinear.

4. A variable valve timing mechanism as set forth in claim 1 wherein said angled contact surface of said valve activator is rectilinear.

5. A variable timing mechanism as set forth in claim 1 or 2 wherein said drive ram includes first and second continuing surfaces offset from said angled drive surface.

6. A variable valve timing mechanism for controlling at least one biased valve comprising a. guide assembly having a mounting surface and a spaced apart upper guide surface, said assembly including support members and spaced apart longitudinal guides supported by support members, b. a closing stop mounted to said mounting surface having and a stop surface;

c. an opening stop having a stop surface;

d. a valve activator movably positioned within said guide assembly and in operable contact with said biased valve, said valve activator having first and second stop surfaces to contact a respective closing stop and opening stop and including first and second offset, continuing surfaces, and an angled contact surface positioned therebetween;

e. a drive ram movably positioned within said guide assembly and in contact with said upper guide surface and said valve activator, said drive ram having a first and second offset, continuing surface, and an angled drive surface positioned therebetween for contacting said valve activator, and f. a drive connected to said drive ram for imparting reciprocating motion thereto, said drive being synchronized with the operation of said valve.

7. A variable valve timing mechanism as set forth in claim 1 wherein said guide assembly comprises a housing integrated into an engine.

8. A variable valve timing mechanism as set forth in claim 1 or 6 wherein said closing stop and said opening stop are adjustably positioned within said guide assembly.

9. A variable valve timing mechanism as set forth in claim 8 including adjusters operably connected to said closing and said opening stops for positioning said stops interdependently of each other.

10. A variable valve timing mechanism as set forth in claim 8 including an adjuster operably connected to each of said closing stop and said opening stop to independently adjust each of said stops.

11. A variable valve timing mechanism as set forth in claim 10 wherein at least one biased valve is an engine valve for use in an internal combustion engine and including controls for said adjusters operable in relationship to a crankshaft in said engine.

12. A variable valve timing mechanism as set forth in claim 7 wherein said closing stop is adjustably positioned on said mounting surface.

13. A variable valve timing mechanism as set forth in claim 7 wherein said drive ram reciprocates within said guide assembly in contact with said upper guide surface and longitudinal guides.

14. A variable valve timing mechanism as set forth in claim 6 wherein the angled surface of each said drive ram and valve activator are complimentary angles of each other.

15. A variable valve timing mechanism of claim 6 wherein said angled surface of each of said drive ram and valve activator is greater than 0° up to about 5° different from the other.

16. A variable valve timing mechanism as set forth in claim 6 wherein said angled surface of said drive ram and said valve activator is greater than 0° and less than 90°.

17. A variable valve timing mechanism as set forth in claim 6 wherein said angled surface of said drive ram and said valve activator is at an angle greater than 0° and less than 45°.

18. A variable valve timing mechanism as set forth in claim 17 wherein said angle is between 30° and 10°.

19. A variable valve timing mechanism as set forth in claim 6 wherein said biased valve is a valve of an internal combustion engine and wherein said drive comprises a rotating shaft having an eccentric for rotation thereon with said eccentric being in contact with said drive ram, said rotating shaft being operably connected to a crankshaft of an engine.

20. A variable valve timing mechanism as set forth in claim 19 wherein said drive ram includes a biasing element to maintain said drive ram in contact with said eccentric.

21. A variable valve timing mechanism as set forth in claim 19 including second rotating shaft having at least a second eccentric thereon for rotation therewith and a second drive ram in contact with said second eccentric and said other drive ram for reciprocation therewith.

22. A variable valve timing mechanism as set forth in claim 6 wherein said drive includes synchronization means.

23. A variable valve timing mechanism as set forth in claim 19 wherein said drive ram is reciprocatingly moved by said rotating shaft.

* * * * *